US012455104B2

(12) United States Patent
Yan et al.

(10) Patent No.: US 12,455,104 B2
(45) Date of Patent: Oct. 28, 2025

(54) STAND-ALONE ICE MAKING APPLIANCE WITH A SIDE TANK FILTER

(71) Applicant: Haier US Appliance Solutions, Inc., Wilmington, DE (US)

(72) Inventors: Bo Yan, Shanghai (CN); Yayu Song, Shanghai (CN); Samuel Vincent DuPlessis, Louisville, KY (US); Gregory Sergeevich Chernov, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/799,548

(22) PCT Filed: Jul. 9, 2021

(86) PCT No.: PCT/CN2021/105356
§ 371 (c)(1),
(2) Date: Aug. 12, 2022

(87) PCT Pub. No.: WO2023/279353
PCT Pub. Date: Jan. 12, 2023

(65) Prior Publication Data

US 2024/0183596 A1 Jun. 6, 2024

(51) Int. Cl.
*F25C 1/25* (2018.01)
*F25C 1/147* (2018.01)

(52) U.S. Cl.
CPC ..... *F25C 1/25* (2018.01); *F25C 1/147* (2013.01); *F25C 2400/12* (2013.01); *F25C 2400/14* (2013.01)

(58) Field of Classification Search
CPC ..... F25C 1/25; F25C 1/147; F25C 2400/12; F25C 2400/14
(Continued)

(56) References Cited

U.S. PATENT DOCUMENTS 2,429,294 A * 10/1947 Pollock ..... F25D 19/02 312/107
3,686,890 A * 8/1972 Lyman ..... F25C 5/142 62/348
(Continued)

FOREIGN PATENT DOCUMENTS

CN 101444396 A 6/2009
CN 102323748 A 10/2012
(Continued)

OTHER PUBLICATIONS

CN-106918174-A, machine translation (Year: 2024).*
(Continued)

*Primary Examiner* — Len Tran
*Assistant Examiner* — Kirstin U Oswald
(74) *Attorney, Agent, or Firm* — Dority & Manning, P.A.

(57) ABSTRACT

A stand-alone ice making appliance, includes a casing. A water tank, an ice maker, and a pump are disposed within the casing. The pump is operable to circulate water from the water tank to the ice maker. An auxiliary water reservoir is disposed outside of the casing. The auxiliary water reservoir is in fluid communication with the water tank such that water within the auxiliary water reservoir is flowable to the water tank. A filter is disposed within the auxiliary water reservoir.

20 Claims, 5 Drawing Sheets

(58) Field of Classification Search
USPC ..... 62/319, 340
See application file for complete search history.

(56) References Cited

U.S. PATENT DOCUMENTS

| | | | | | |
|---|---|---|---|---|---|
| 3,796,063 | A * | 3/1974 | Wulke | F25C 1/04 | 62/340 |
| 4,027,499 | A * | 6/1977 | Barto | F25D 23/126 | 62/340 |
| 4,448,032 | A * | 5/1984 | Hibino | F25C 1/12 | 414/269 |
| 4,508,023 | A * | 4/1985 | Naya | A47J 31/0573 | 392/467 |
| 5,297,401 | A * | 3/1994 | Hawco | B67D 1/0858 | 220/666 |
| 7,591,399 | B2 | 9/2009 | Hortin | | |
| 9,273,894 | B1 * | 3/2016 | Whitty | F25C 1/00 | |
| 10,578,346 | B2 * | 3/2020 | Tarr | F25D 27/00 | |
| 2003/0010054 | A1 * | 1/2003 | Esch | F25C 1/147 | 62/250 |
| 2007/0201602 | A1 | 8/2007 | Isono et al. | | |
| 2008/0277407 | A1 * | 11/2008 | Leonetti | G07F 11/08 | 221/22 |
| 2012/0186292 | A1 * | 7/2012 | Kim | F25C 1/20 | 62/340 |
| 2013/0133352 | A1 * | 5/2013 | Park | F25D 23/126 | 62/340 |
| 2017/0135520 | A1 * | 5/2017 | Sato | A23F 5/26 | |
| 2017/0284721 | A1 * | 10/2017 | DuPlessis | F25C 5/142 | |
| 2017/0284722 | A1 * | 10/2017 | Chernov | F25C 1/147 | |
| 2018/0001239 | A1 * | 1/2018 | Chernov | C02F 1/003 | |
| 2018/0001240 | A1 * | 1/2018 | Chernov | B01D 29/90 | |
| 2018/0008915 | A1 * | 1/2018 | Chernov | B01D 35/30 | |
| 2018/0017304 | A1 * | 1/2018 | Knatt | F25C 5/04 | |
| 2018/0058743 | A1 * | 3/2018 | Vorosmarti, III | F25C 5/182 | |
| 2018/0080698 | A1 * | 3/2018 | Tarr | F25C 1/147 | |
| 2018/0372388 | A1 * | 12/2018 | Mitchell | C02F 1/008 | |

FOREIGN PATENT DOCUMENTS

| | | | | |
|---|---|---|---|---|
| CN | 106918174 | A * | 7/2017 | F25C 1/00 |
| CN | 109147967 | A | 1/2019 | |
| CN | 109190145 | A | 1/2019 | |
| CN | 109543222 | A | 3/2019 | |
| CN | 110879620 | A | 3/2020 | |
| CN | 111238107 | A * | 6/2020 | H02J 7/35 |
| CN | 111262280 | A | 6/2020 | |
| CN | 109597328 | A | 2/2021 | |
| CN | 108962410 | A | 4/2021 | |
| CN | 112394639 | A | 8/2021 | |
| CN | 111780089 | A | 11/2021 | |
| CN | 111462925 | A | 4/2022 | |
| CN | 111564226 | A | 5/2022 | |
| EP | 3406992 | A1 * | 11/2018 | F25C 1/25 |
| JP | 2006208037 | A | 8/2006 | |
| JP | 2006317133 | A * | 11/2006 | |
| JP | 4431451 | B2 | 3/2010 | |

OTHER PUBLICATIONS

JP-2006317133-A, machine translation (Year: 2025).*
CN-111238107-A, machine translation (Year: 2025).*
International Search Report Corresponding to Application No. PCT/CN2021/115643 on Nov. 11, 2021.

* cited by examiner

STAND-ALONE ICE MAKING APPLIANCE WITH A SIDE TANK FILTER

CROSS-REFERENCE TO RELATED APPLICATIONS

The present application is the National Stage Entry of and claims the benefit of priority under 35 U.S.C. § 371 to PCT Application Serial No. PCT/CN2021/105356 filed Jul. 9, 2021 and entitled STAND-ALONE ICE MAKING APPLIANCE WITH A SIDE TANK FILTER, which is hereby incorporated by reference in its entirety.

FIELD OF THE INVENTION

The present subject matter relates generally to ice making appliances, and more particularly to ice making appliances that produce nugget ice.

BACKGROUND OF THE INVENTION

Ice makers generally produce ice for use by consumers, such as in beverages, for cooling food items, etc. Certain refrigerator appliances include ice makers for producing ice. The ice maker can be positioned within the appliance's freezer chamber and direct ice into an ice bucket where the ice is stored within the freezer chamber. Such refrigerator appliances can also include a dispensing system for assisting a user with accessing ice produced by the refrigerator appliance's ice maker. However, the incorporation of ice makers into refrigerator appliances can have drawbacks, such as limits on the amount of ice that can be produced and the reliance on the refrigeration system of the refrigerator appliance to form the ice.

Recently, stand-alone ice makers have been developed. These ice makers are separate from refrigerator appliances and provide independent ice supplies. Generally, liquid water is added to the stand-alone ice makers, and the ice makers operate to freeze the liquid water and form ice. Users frequently add tap water to the stand-alone ice makers. Tap water may include various impurities that negatively affect the appearance and/or taste of ice cubes formed from the tap water.

Accordingly, improved stand-alone ice makers are desired in the art. In particular, cost-effective stand-alone ice makers that address several of the above issues would be advantageous.

BRIEF DESCRIPTION OF THE INVENTION

A stand-alone ice making appliance may include a supplemental water reservoir, such as a side water tank. A filter may be positioned within the supplemental water reservoir, and the filter may be gravity fed. A pump, such as a centrifugal pump, may flow water through the stand-alone ice making appliance. Aspects and advantages of the invention will be set forth in part in the following description, or may be obvious from the description, or may be learned through practice of the invention.

In one exemplary aspect of the present disclosure, a stand-alone ice making appliance includes a casing. A water tank, an ice maker, and a pump are disposed within the casing. The pump is in fluid communication with the water tank and the ice maker. The pump is operable to circulate water from the water tank to the ice maker. An auxiliary water reservoir is disposed outside of the casing. The auxiliary water reservoir is in fluid communication with the water tank such that water within the auxiliary water reservoir is flowable to the water tank. A filter is disposed within the auxiliary water reservoir.

In another exemplary aspect of the present disclosure, a stand-alone ice making appliance includes a casing. A water tank, an ice maker, and a pump are disposed within the casing. The pump is in fluid communication with the water tank and the ice maker. The pump is operable to circulate water from the water tank to the ice maker. An auxiliary water reservoir is disposed outside of the casing. The auxiliary water reservoir is in fluid communication with the water tank such that water within the auxiliary water reservoir is flowable to the water tank. The auxiliary water reservoir defines an inlet and an outlet. A filter is disposed within the auxiliary water reservoir. The filter is configured such that water within the auxiliary water reservoir is gravity fed through the filter between the inlet and the outlet of the auxiliary water reservoir.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
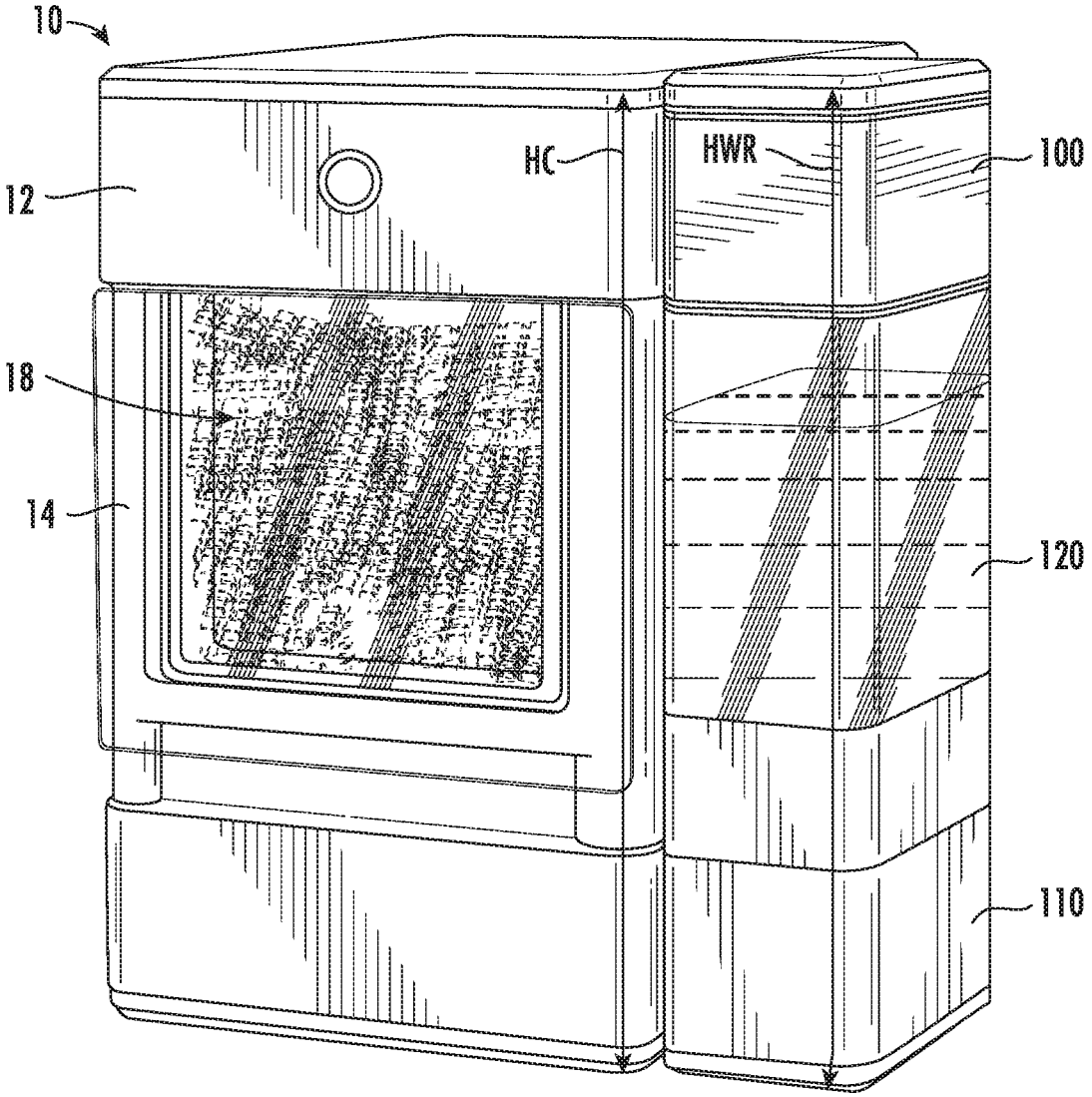
FIG. 1 is a perspective view of an appliance according to an example embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a ten percent (10%) margin.

Figure 2:
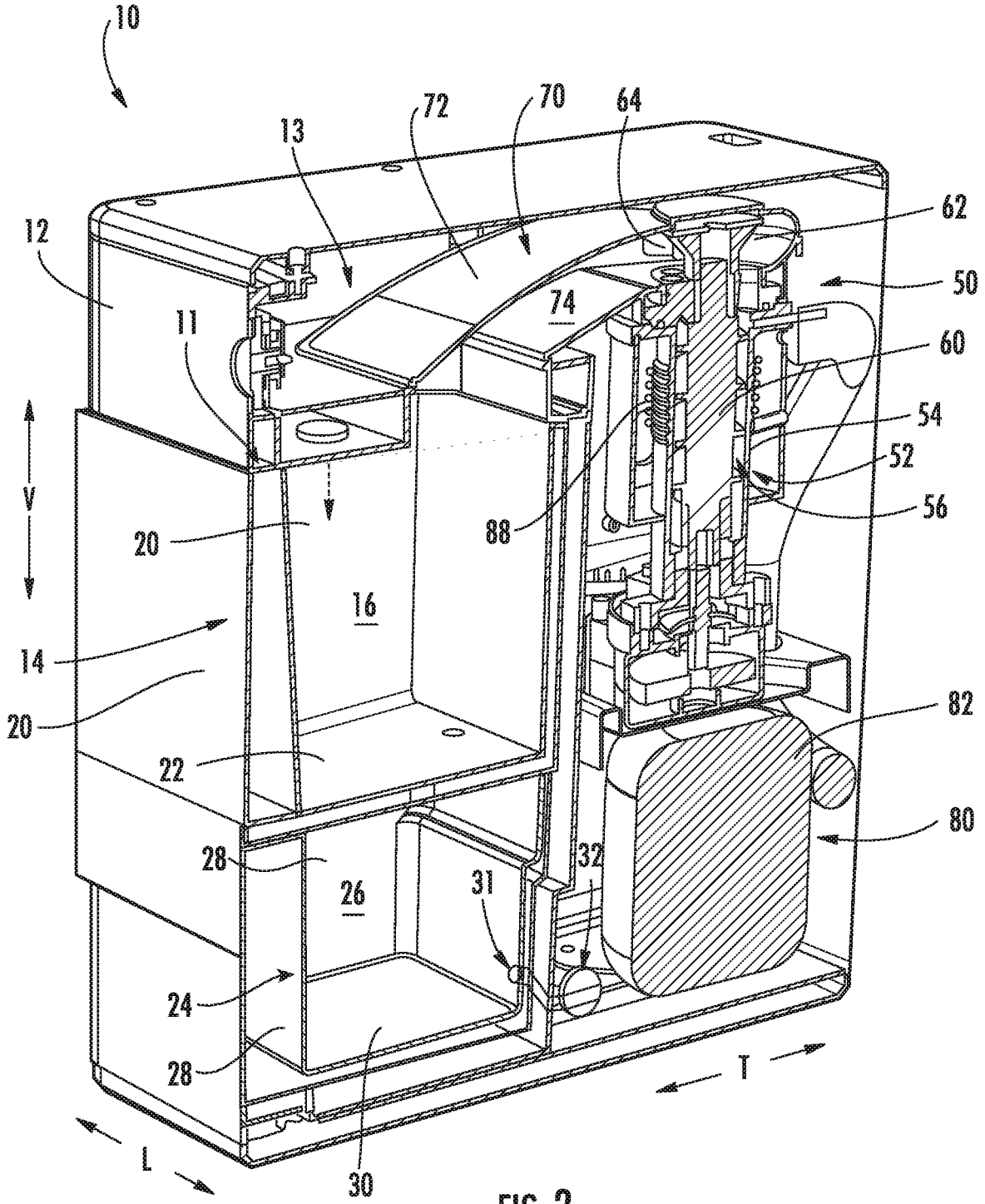
FIG. 2 is a perspective section view of the example appliance of FIG. 1.
Figure 3:
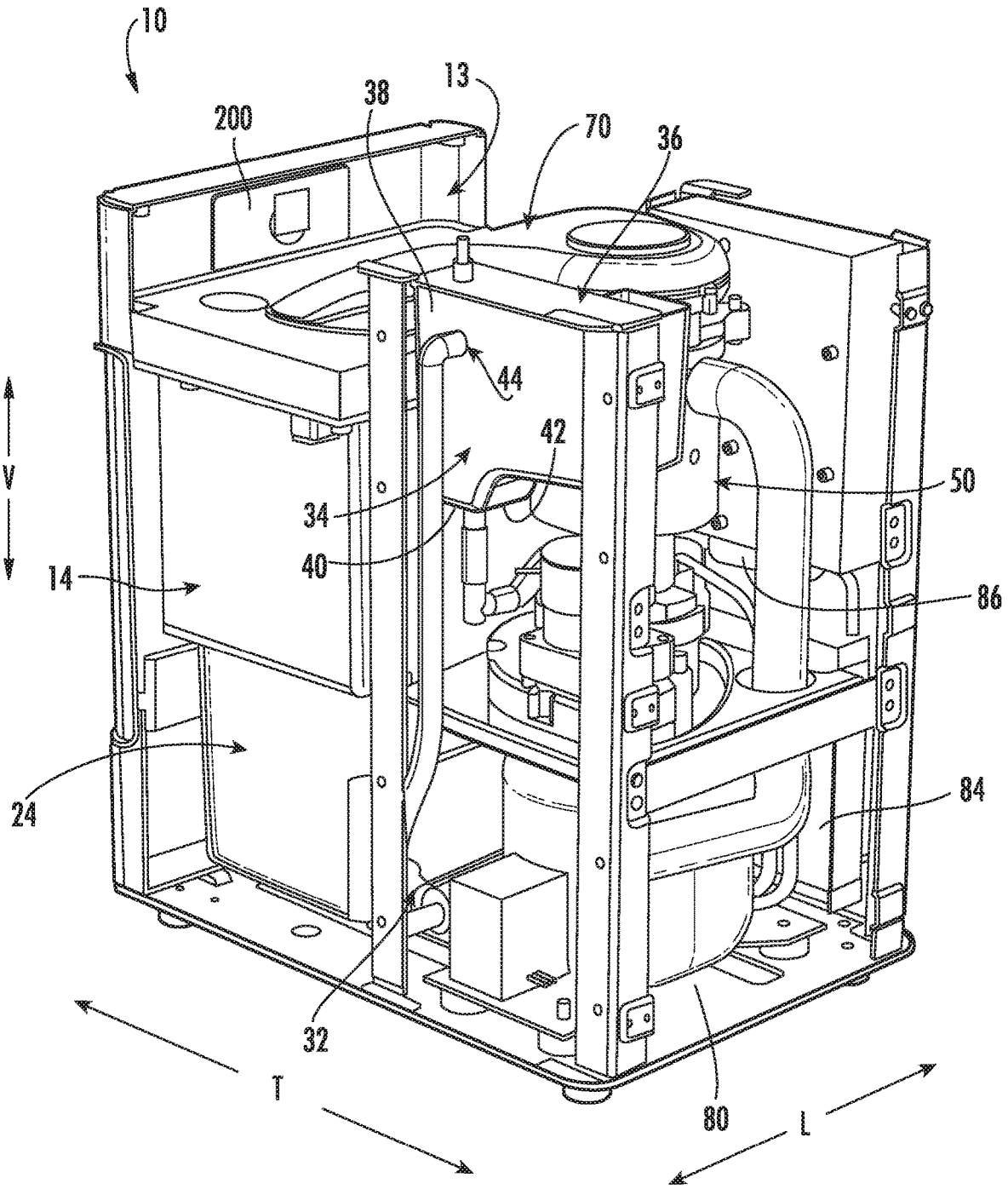
FIG. 3 is a rear perspective view of the example appliance of FIG. 1 with a casing of the example appliance removed to show interior components of the example appliance.

Referring now to FIGS. 1 through 3, one embodiment of an appliance 10 in accordance with the present disclosure is illustrated. As shown, appliance 10 is provided as a stand-alone ice making appliance embodiment. Appliance 10 includes an outer casing 12 which defines a primary opening 11 (e.g., first primary opening) and an internal cavity or volume 13. Internal volume 13 generally at least partially houses various other components of the appliance therein 10. Primary opening 11 defined in outer casing 12 may extend internal volume 13 to an ambient environment. Through primary opening 11, access (e.g., by a user) to the internal volume 13 may be permitted. Outer casing 12 further defines a vertical direction V, a lateral direction L, and a transverse direction T. The vertical direction V, lateral direction L, and transverse direction T are mutually perpendicular and form an orthogonal direction system.

A container 14 of appliance 10 is also illustrated. Container 14 defines a first storage volume 16 for the receipt and storage of ice 18 therein. A user of the appliance 10 may access ice 18 within the container 14 for consumption or other uses, as described in detail below. Container 14 may include multiple walls, including one or more sidewalls 20 and a base wall 22, which may together define the first storage volume 16. In exemplary embodiments, at least one sidewall 20 may be formed in part from a clear, see-through (i.e., transparent or translucent) material, such as a clear glass or plastic, such that a user can see into the first storage volume 16 and thus view ice 18 therein. For instance, at least one sidewall 20 may include a separate external panel and internal panel formed from a clear, see-through (i.e., transparent or translucent) material, such as a clear glass or plastic. Further, in exemplary embodiments, container 14 may be removable, such as from the outer casing 12, by a user. This facilitates advantageous easy access by the user to ice within the container 14, as discussed below.

Appliances 10 in accordance with the present disclosure are advantageously stand-alone appliances, and thus are not connected to refrigerators or other appliances. Additionally, in exemplary embodiments, such appliances are not connected to plumbing or another water source that is external to the appliance 10, such as a refrigerator water source. Rather, in exemplary embodiments, water is initially supplied to the appliance 10 manually by a user, such as by pouring water into water tank 24 and/or an auxiliary reservoir 100. Optionally, in exemplary embodiments, water tank 24 may be removable, such as from the outer casing 12, by a user. This facilitates advantageous easy access by the user to water tank 24 (e.g., in order to easily fill water tank 24), as discussed below.

Notably, appliances 10 as discussed herein include various features which allow the appliances 10 to be affordable and desirable to typical consumers. For example, the stand-alone feature reduces the cost associated with the appliance 10 and allows the consumer to position the appliance 10 at any suitable desired location, with the only requirement in some embodiments being access to an electrical source. In exemplary embodiments, such as those shown in FIGS. 1 through 3, the removable container 14 allows easy access to ice 18 within first storage volume 16 and allows the container 14 to be moved to a different position from the remainder of the appliance 10 for ice usage purposes.

As discussed herein, appliance 10 is configured to make nugget ice, which is becoming increasingly popular with consumers. Ice 18 may be nugget ice. Generally, nugget ice is ice that that is maintained or stored (i.e., in first storage volume 16 of container 14) at a temperature greater than the melting point of water or greater than about thirty-two degrees Fahrenheit. Accordingly, the ambient temperature of the environment surrounding the container 14 may be at a temperature greater than the melting point of water or greater than about thirty-two degrees Fahrenheit. In some embodiments, such temperature may be greater than forty degrees Fahrenheit, greater than fifty degrees Fahrenheit, or greater than sixty degrees Fahrenheit.

Still referring to FIGS. 1 through 3, various components of appliance 10 in accordance with the present disclosure are illustrated. For example, as mentioned, appliance 10 includes a water tank 24. The water tank 24 defines a second storage volume 26 for the receipt and holding of water. Water tank 24 may include multiple walls, including one or more sidewalls 28 and a base wall 30, which may together define the second storage volume 26. In exemplary embodiments, the water tank 24 may be disposed below the container 14 along the vertical direction V defined for the appliance 10, as shown.

As discussed, in exemplary embodiments, water is provided to the water tank 24 for use in forming ice. Accordingly, appliance 10 may further include a pump 32. Pump 32 may be in fluid communication with the second storage volume 26. For example, water may be flowable from the second storage volume 26 through a fluid outlet 31 defined in the water tank 24, such as in a sidewall 28 thereof, and may flow through a conduit to and through pump 32. Pump 32 may, when activated, actively flow water from the second storage volume 26 therethrough and from the pump 32.

Water actively flowed from the pump 32 may be flowed (e.g., through a suitable conduit) to a reservoir 34. For example, reservoir 34 may define a third storage volume 36. In some embodiments, third storage volume 36 is defined by one or more sidewalls 38 and a base wall 40. Third storage volume 36 may, for example, be in fluid communication with the pump 32 and may thus receive water that is actively flowed from the water tank 24, such as through the pump 32. During operation, water may be flowed into the third storage volume 36 through an opening 44 defined in the reservoir 34.

Reservoir 34 and third storage volume 36 thereof may receive and contain water to be provided to an ice maker 50 for the production of ice. Accordingly, third storage volume 36 may be in fluid communication with ice maker 50. For example, water may be flowed, such as through an opening 42 and through suitable conduits, from third storage volume 36 to ice maker 50.

Ice maker 50 generally receives water, such as from reservoir 34, and freezes the water to form ice 18. In exemplary embodiments, ice maker 50 is a nugget ice maker, and in particular is an auger-style ice maker, although other suitable styles of ice makers and/or appliances are within the scope and spirit of the present disclosure. As shown, ice maker 50 may include a casing 52 into which water from third storage volume 36 is flowed. Casing 52 is thus in fluid communication with third storage volume 36. For example, casing 52 may include one or more sidewalls 54 which may define an interior volume 56, and an opening may be defined in a sidewall 54. Water may be flowed from third storage volume 36 through the opening (such as via a suitable conduit) into the interior volume 56.

As illustrated, an auger 60 may be disposed at least partially within the casing 52. During operation, the auger 60 may rotate. Water within the casing 52 may at least partially freeze due to heat exchange, such as with a refrigeration system as discussed herein. The at least partially frozen water may be lifted by the auger 60 from casing 52. Further, in exemplary embodiments, the at least partially frozen water may be directed by auger 60 to and through an extruder 62. The extruder 62 may extrude the at least partially frozen water to form ice, such as nuggets of ice 18.

Formed ice 18 may be provided by the ice maker 50 to container 14, and may be received in the first storage volume 16 thereof. For example, ice 18 formed by auger 60 and/or extruder 62 may be provide to the container 14. In exemplary embodiments, appliance 10 may include a chute 70 for directing ice 18 produced by the ice maker 50 towards the first storage volume 16. For example, as shown, chute 70 is generally positioned above container 14 along the vertical direction V. Thus, ice can slide off of chute 70 and drop into storage volume 16 of container 14. Chute 70 may, as shown, extend between ice maker 50 and container 14, and may include a body 72, which defines a passage 74 therethrough. Ice 18 may be directed from the ice maker 50 (such as from the auger 60 and/or extruder 62) through the passage 74 to the container 14. In some embodiments, for example, a sweep 64, which may be connected to and rotate with the auger, may contact the ice emerging through the extruder 62 from the auger 60 and direct the ice 18 through the passage 74 to the container 14.

As discussed, water within the casing 52 may at least partially freeze due to heat exchange, such as with a refrigeration system. In exemplary embodiments, ice maker 50 may include a sealed refrigeration system 80. The sealed refrigeration system 80 may be in thermal communication with the casing 52 to remove heat from the casing 52 and interior volume 56 thereof, thus facilitating freezing of water therein to form ice. Sealed refrigeration system 80 may, for example, include a compressor 82, a condenser 84, a throttling device 86, and an evaporator 88. Evaporator 88 may, for example, be in thermal communication with the casing 52 in order to remove heat from the interior volume 56 and water therein during operation of sealed system 80. For example, evaporator 88 may at least partially surround the casing 52. In particular, evaporator 88 may be a conduit coiled around and in contact with casing 52, such as the sidewall(s) 54 thereof.

It should additionally be noted that, in exemplary embodiments, a controller 200 may be in operative communication with the sealed system 80, such as with the compressor 82 thereof, and may activate the sealed system 80 as desired or required for ice making purposes.

In exemplary embodiments, controller 200 is in operative communication with the pump 32. Such operative communication may be via a wired or wireless connection, and may facilitate the transmittal and/or receipt of signals by the controller 200 and pump 32. Controller 200 may be configured to activate the pump 32 to actively flow water. For example, controller 200 may activate the pump 32 to actively flow water therethrough when, for example, reservoir 34 requires water. A suitable sensor(s), for example, may be provided in the third storage volume 36. The sensor(s) may be in operative communication with the controller 200 and may be configured to transmit signals to the controller 200, which indicate whether or not additional water is desired in the reservoir 34. When controller 200 receives a signal that water is desired, controller 200 may send a signal to pump 32 to activate pump 32.

Figure 4:
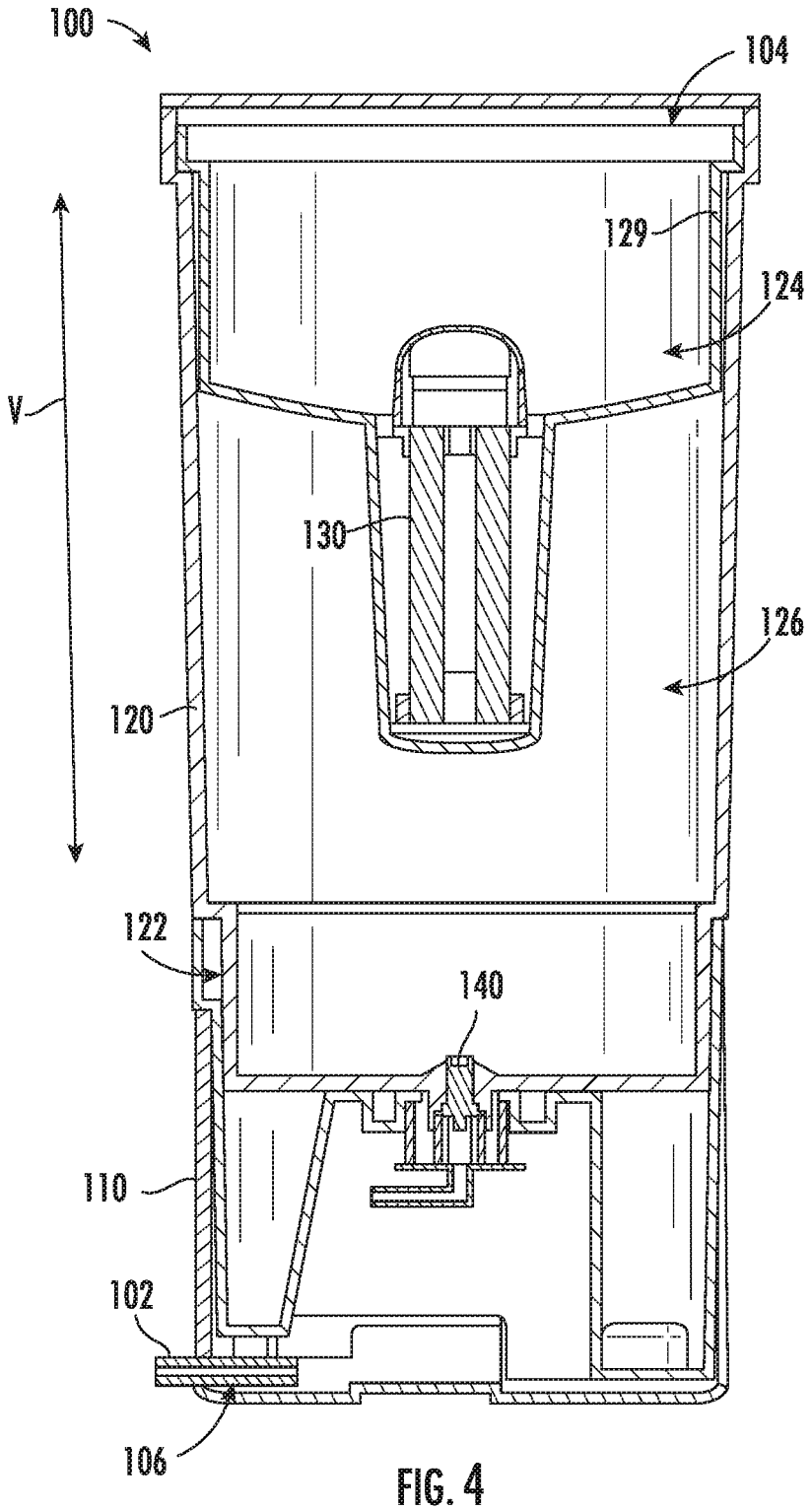
FIG. 4 is a side section view of an auxiliary reservoir for an appliance, such as the example appliance of FIG. 1, according to an example embodiment of the present disclosure.
Figure 5:
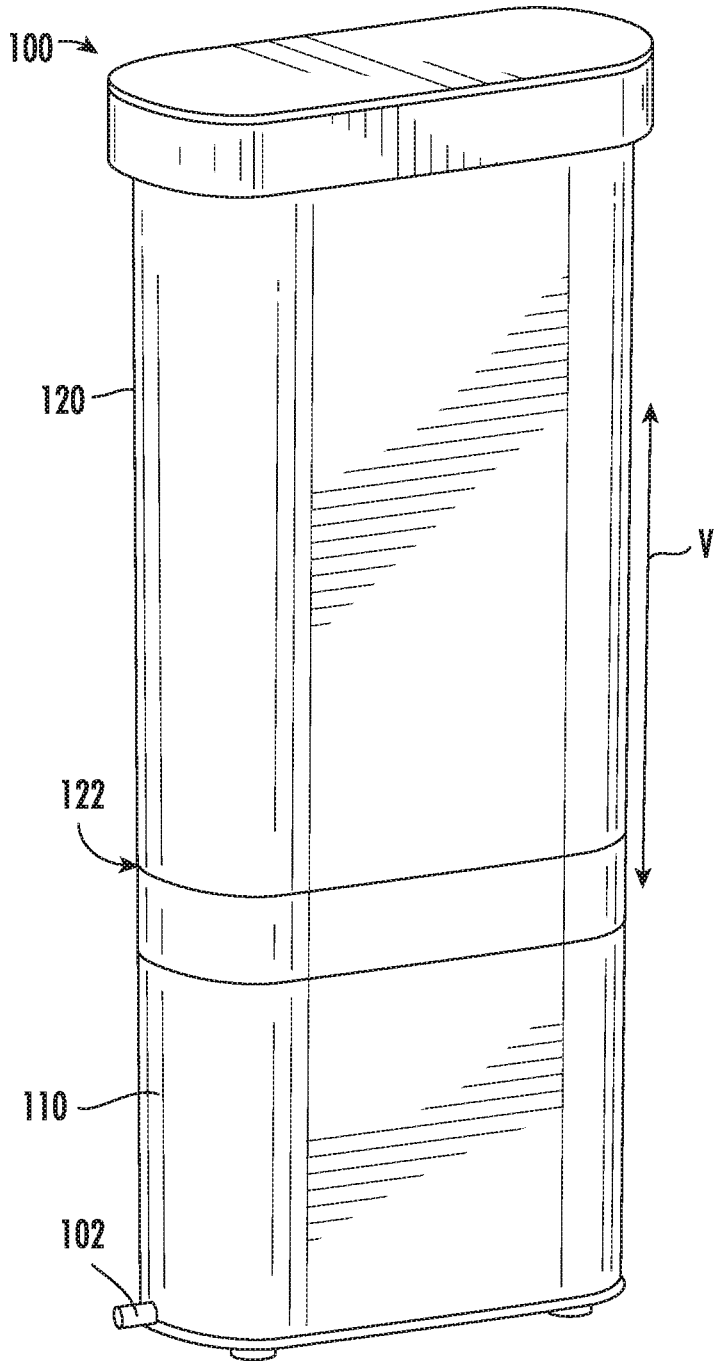
FIG. 5 is a perspective view of the example auxiliary reservoir if FIG. 4.

As shown in FIG. 1, appliance 10 may also include an auxiliary water reservoir 100. FIGS. 4 and 5 also illustrate auxiliary water reservoir 100 according to another example embodiment. Auxiliary water reservoir 100 is described in greater detail below with reference to FIGS. 1, 4, and 5. As may be seen in FIG. 1, a height HWR of auxiliary water reservoir 100 may be about equal to a height HC of casing 12. Thus, the appearance of auxiliary water reservoir 100 may complement casing 12.

Auxiliary water reservoir 100 is disposed outside of casing 12. For example, auxiliary water reservoir 100 may be mounted at a side of casing 12. Thus, while most components of appliance 10 are housed within casing 12, auxiliary water reservoir 100 is positioned outside of casing 12. In certain example embodiments, auxiliary water reservoir 100 may include a base 110 and a container 120. Base 110 may be attached to casing 12, e.g., at the side of casing 12 adjacent the bottom of casing 12. For instance, base 110 may be clipped, fastened, etc. to casing 12. Container 120 is removably mounted to base 110. For example, a bottom portion 122 of container 120 may be received within base 110 to mount container 120 on base 110. A user may lift upwardly on container 120 to remove container 120 from base 110, and the user may insert bottom portion 122 of container 120 into base to mount container 120 on base 110. As an example, the user may remove container 120 from base 110 in order to conveniently fill container 120 with water at a faucet.

Auxiliary water reservoir 100 may be in fluid communication with a water tank within casing 12 such that water within auxiliary water reservoir 100 is flowable to the water tank. For example, a supply line 102 may extend from auxiliary water reservoir 100 to water tank 24, and water from within auxiliary water reservoir 100 may flow from auxiliary water reservoir 100 into second storage volume 26 via supply line 102. It will be understood that appliance 10 may be plumbed in any other suitable manner to deliver water from auxiliary water reservoir 100 into casing 12 for use with ice maker 50 in alternative example embodiments.

As discussed in greater detail below, auxiliary water reservoir 100 includes features for filtering water prior to the water entering casing 12. By filtering water in auxiliary water reservoir 100, impurities that negatively affect the appearance and/or taste of ice formed by ice maker 50 may be removed from the water. Thus, the appearance and/or taste of the water may be improved.

As shown in FIG. 4, a filter 130 may be disposed within auxiliary water reservoir 100. For instance, auxiliary water reservoir 100 may define an inlet 104 and an outlet 106. Water may be added to auxiliary water reservoir 100 at inlet 104. For example, a user may position inlet 104 below a faucet and open the faucet to flow water into auxiliary water reservoir 100. As another example, the user may use a pitcher or other vessel to pour water into auxiliary water reservoir 100 through inlet 104. Water may flow from auxiliary water reservoir 100 at outlet 106. For example, outlet 106 may be coupled to supply line 102, and water from within auxiliary water reservoir 100 may flow from outlet 106 into second storage volume 26 via supply line 102. Filter 130 may be disposed within auxiliary water reservoir 100 between inlet 104 and outlet 106 to filter water within auxiliary water reservoir 100 between inlet 104 and outlet 106.

Filter 130 may be configured such that water within auxiliary water reservoir 100 is gravity fed through filter 130 between inlet 104 and outlet 106 of auxiliary water reservoir 100. For example, container 120 may define a first reservoir volume 124 and a second reservoir volume 126. First reservoir volume 124 may be positioned adjacent or contiguous with inlet 104 of auxiliary water reservoir 100, and second reservoir volume 126 may be disposed below first reservoir volume 124. A divider wall 128 may be disposed between first and second reservoir volumes 124, 126. Thus, e.g., first and second reservoir volumes 124, 126 may be separated by divider wall 128. Filter 130 may be mounted to divider wall 128. Moreover, filter 130 may be disposed between first and second reservoir volumes 124, 126 on divider wall 128. Thus, e.g., divider wall 128 may block water from flowing downwardly from first reservoir volume 124 into second reservoir volume 126 except through filter 130. In particular, unfiltered water (relative to filter 130) may fill first reservoir volume 124, and gravity may urge the water within first reservoir volume 124 into filter 130. Divider wall 128 may be removably mounted within an interior of container 120. For instance, divider wall 128 may form a bottom of a divider insert 129 received within container 120. Divider insert 129 may have a shape that is complementary to container 120, and divider insert 129 may define first reservoir volume 124 therein. Filter 130 may be mounted to divider wall 128 with filter 130 positioned at the only passage through divider wall 128 from first reservoir volume 124 to second reservoir volume 126.

From filter 130, filtered water (relative to filter 130) may exit filter 130 and fill second reservoir volume 126. As may be seen from the above, filter 130 may be disposed between first and second reservoir volumes 124, 126, and filter 130 may filter water flowing from first reservoir volume 124 into second reservoir volume 126 due to gravity urging the water through filter 130. To facilitate the gravity fed flow of water through filter 130, second reservoir volume 126 may be larger than first reservoir volume 124. Such sizing may advantageously reduce the risk of overflowing second reservoir volume 126. Filter 130 may include a suitable filter medium therein, such as one or more of an activated carbon block, a pleated polymer sheet, a spun cord material, or a melt blown material. Filter 130 may be replaced or serviced at regular intervals.

Auxiliary water reservoir 100 may include a check valve 140, such as a normally closed check valve. Check valve 140 may be mounted to container 120, e.g., at bottom portion 122 of container 120, at second reservoir volume 126. Check valve 140 may be configured such that check valve 140 is open when container 120 is mounted to base 110. In addition, check valve 140 may be configured such that check valve 140 is closed when container 120 is removed from base 110. When check valve 140 is open, check valve 140 may allow filtered water within second reservoir volume 126, to flow from container 120 into base 110. Within base 110, the filtered water may flow to outlet 106 and thus supply line 102, as described above.

Positioning filter 130 within auxiliary water reservoir 100 may have various advantages. For example, auxiliary water reservoir 100 may be plumbed as branch into a circulation loop within casing 12 formed by container 14, water tank 24, reservoir 34, and ice maker 50. Pump 32 may be operable to circulate water from water tank 24 to reservoir 34 and ice maker 50, and melt water runoff from ice within container 14 may flow back into water tank 24. Positioning a filter in the circulation loop may disadvantageously limit the choice of pump. For example, a diaphragm pump may be required to over come the restriction formed by the filter and flow water from water tank 24 to reservoir 34 and ice maker 50. However, diaphragm pumps may be less reliable and more expensive than other pump types. By positioning filter 130 within auxiliary water reservoir 100, pump 32 may be a centrifugal pump that is more reliable and less expensive than diaphragm pumps. For instance, water within auxiliary water reservoir 100 may be gravity fed through filter 130 in auxiliary water reservoir 100 into a water tank within casing 12, such as water tank 24. Thus, no pump may be required to force water through filter 130. Once in the water tank within casing 12, e.g., water tank 24, the filtered water from filter 130 may be more freely circulated within casing 12, as compared to if filter 130 were installed within casing 12 such that pump 32 actively flows water through filter 130. However, pump 32 may be a diaphragm pump, a gear pump, or another style of pump in alternative example embodiments.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A stand-alone ice making appliance, comprising:

a casing;

a water tank disposed within the casing;

an ice maker disposed within the casing;

a pump disposed within the casing, the pump positioned between the water tank and the ice maker and in fluid communication between the water tank and the ice maker, the pump operable to flow water from the water tank to the ice maker;

an auxiliary water reservoir mounted to a side of the casing and positioned entirely outside of the casing, the auxiliary water reservoir comprising a base and a container, the base attached to the side of the casing adjacent a bottom of the casing, a bottom portion of the container removably received within a top portion of the base, the auxiliary water reservoir in upstream fluid communication with the water tank such that water within the auxiliary water reservoir is flowable to the water tank; and a filter disposed within the auxiliary water reservoir.

2. The stand-alone appliance of claim 1, wherein the container defines a first reservoir volume adjacent an inlet of the auxiliary water reservoir and a second reservoir volume disposed below the first reservoir volume, a divider wall is disposed between the first reservoir volume and the second reservoir volume within the auxiliary water reservoir, and the filter is mounted to the divider wall.

3. The stand-alone appliance of claim 2, wherein the filter is configured such that water in the first reservoir volume is gravity fed through the filter from the first reservoir volume to the second reservoir volume.

4. The stand-alone appliance of claim 2, wherein the second reservoir volume is larger than the first reservoir volume.

5. The stand-alone appliance of claim 2, wherein the auxiliary water reservoir comprises a check valve mounted to the bottom portion of the container at the second reservoir volume, the check valve configured such that the check valve is open when the container is mounted to the base and that the check valve is closed when the container is removed from the base.

6. The stand-alone appliance of claim 1, wherein the container comprises a divider wall removably mounted within an interior of the container, the filter mounted to the divider wall.

7. The stand-alone appliance of claim 1, wherein the filter comprises a carbon block filter medium.

8. The stand-alone appliance of claim 1, wherein the pump is a centrifugal pump.

9. The stand-alone appliance of claim 1, wherein a height of the auxiliary water reservoir is about equal to a height of the casing.

10. The stand-alone appliance of claim 1, wherein the base defines an outlet in downstream fluid communication with the container, and wherein the outlet is in upstream fluid communication with the water tank.

11. A stand-alone ice making appliance, comprising:

a casing;

a water tank disposed within the casing;

an ice maker disposed within the casing;

a pump disposed within the casing, the pump positioned between the water tank and the ice maker and in fluid communication between the water tank and the ice maker, the pump operable to circulate water from the water tank to the ice maker;

an auxiliary water reservoir positioned entirely outside of the casing, the auxiliary water reservoir comprising a base and a container, the base being clipped to a side of the casing adjacent a bottom of the casing, a bottom portion of the container being removably received within a top portion of the base, the auxiliary water reservoir in upstream fluid communication with the water tank such that water within the auxiliary water reservoir is flowable to the water tank, the auxiliary water reservoir defining an inlet and an outlet; and a filter disposed within the auxiliary water reservoir, the filter configured such that water within the auxiliary water reservoir is gravity fed through the filter between the inlet and the outlet of the auxiliary water reservoir, the filter being in upstream fluid communication with the water tank to filter water prior to water entering the casing.

12. The stand-alone appliance of claim 11, wherein the container defines a first reservoir volume adjacent the inlet of the auxiliary water reservoir and a second reservoir volume disposed below the first reservoir volume, a divider wall is disposed between the first reservoir volume and the second reservoir volume within the auxiliary water reservoir, and the filter is mounted to the divider wall.

13. The stand-alone appliance of claim 12, wherein the filter is configured such that water in the first reservoir volume is gravity fed through the filter from the first reservoir volume to the second reservoir volume.

14. The stand-alone appliance of claim 12, wherein the second reservoir volume is larger than the first reservoir volume.

15. The stand-alone appliance of claim 12, wherein the auxiliary water reservoir comprises a check valve mounted to the bottom portion of the container at the second reservoir volume, the check valve configured such that the check valve is open when the container is mounted to the base and that the check valve is closed when the container is removed from the base.

16. The stand-alone appliance of claim 11, wherein the container comprises a divider wall removably mounted within an interior of the container, the filter mounted to the divider wall.

17. The stand-alone appliance of claim 11, wherein the filter comprises a carbon block filter medium.

18. The stand-alone appliance of claim 11, wherein the pump is a centrifugal pump.

19. The stand-alone appliance of claim 11, wherein a height of the auxiliary water reservoir is about equal to a height of the casing.

20. The stand-alone appliance of claim 11, wherein outlet is in downstream fluid communication with the container, and wherein the outlet is in upstream fluid communication with the water tank.

* * * * *